United States Patent [19]

Field et al.

[11] 4,350,453

[45] Sep. 21, 1982

[54] CARTRIDGE FOR CORRECTION MEDIA OR TACKY TAPE WITH A WRAP SPRING

[75] Inventors: Thomas R. Field; Peter F. Jagodzinski, both of Lexington; James F. King, Irvine; John O. Schaefer, Lexington, all of Ky.

[73] Assignee: International Business Machines Corporation, Armonk, N.Y.

[21] Appl. No.: 165,827

[22] Filed: Jul. 3, 1980

[51] Int. Cl.[3] ..... B41J 33/14

[52] U.S. Cl. ..... 400/208; 400/234; 400/696

[58] Field of Search ..... 400/208, 219.3, 234, 400/696, 697; 242/197, 198, 199, 200; 267/158

[56] References Cited

U.S. PATENT DOCUMENTS

| | | | |
|---|---|---|---|
| 2,118,896 | 5/1938 | Pearlman et al. | 242/199 |
| 3,111,281 | 11/1963 | Sinkewitsch | 242/200 |
| 3,356,202 | 12/1967 | Goff, Jr. | 400/208 |
| 3,513,957 | 5/1970 | Ricciardi et al. | 400/208 |
| 3,601,654 | 8/1971 | Long et al. | 242/199 X |
| 3,632,052 | 1/1972 | Read | 400/219.3 X |
| 3,833,185 | 9/1972 | Talavera | 242/199 |
| 3,889,310 | 6/1975 | Barouh et al. | 242/199 X |
| 3,889,795 | 6/1975 | Garberi et al. | 400/208 |
| 3,915,409 | 10/1975 | Satou | 242/199 |
| 4,013,160 | 3/1977 | Colecchi et al. | 400/208 |
| 4,030,685 | 6/1977 | Suzuki et al. | 242/199 |
| 4,147,439 | 4/1979 | Colecchi | 400/208 |

FOREIGN PATENT DOCUMENTS 1813193 8/1970 Fed. Rep. of Germany ..... 400/208

*Primary Examiner*—Ernest T. Wright, Jr.
*Attorney, Agent, or Firm*—Laurence R. Letson

[57] ABSTRACT

A typewriter correction tape cartridge for holding and feeding correction tape for a correcting typewriter is improved by the addition of a beam spring cantilever supported such that one end of the beam spring wipes the correction tape onto the takeup spool. This will act to eliminate bubbles, wrinkles and crimps in the tape as it is placed in a new convolution on the spool and will thus reduce the outside diameter of the ultimate disc of used tape. The advantage of this spring is that a reduced size cartridge may be used while utilizing the entire volume of tape supplied on the supply side of the cartridge and, secondly, a more reliable takeup is accomplished due to the elimination of irregularities in the takeup disc. Where space considerations dictate that the spring be bent back sufficiently to accommodate a full spool without contacting the disc of ribbon accumulated on the takeup spool, the cross section of the spring, at a point near the anchor point, may be reduced by notching to provide a stress concentrated flex point and allow the spring member to still perform its function without premature engagement with the disc at a point other than at the wiper end.

3 Claims, 7 Drawing Figures

FIG. 1
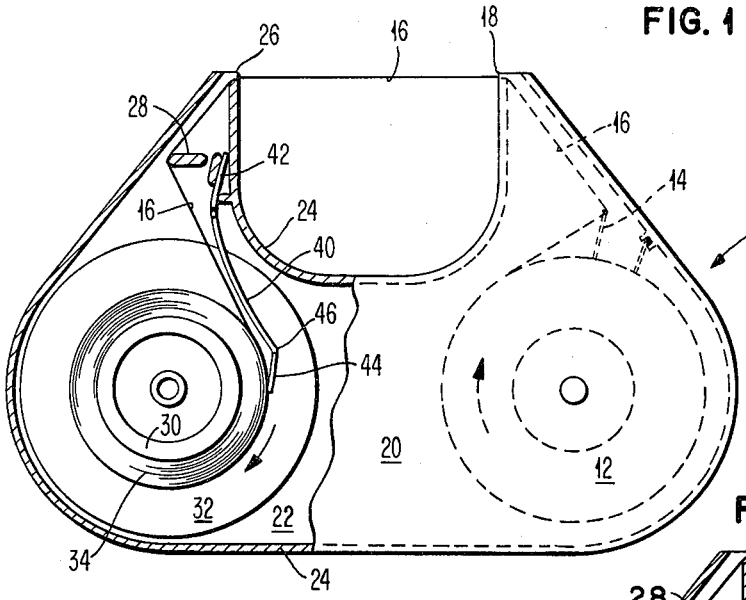
FIG. 2
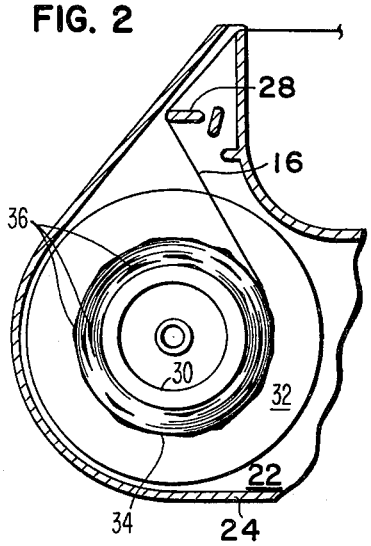
FIG. 3
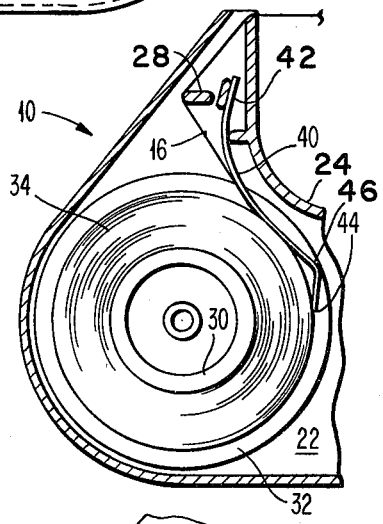
FIG. 5
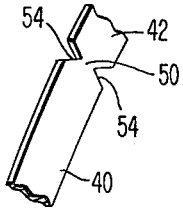
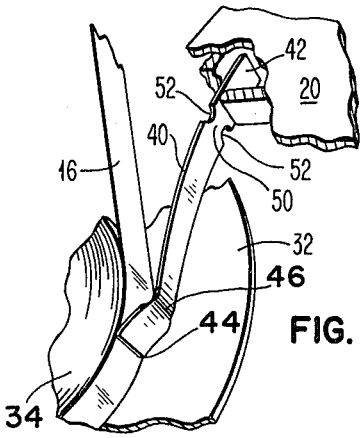
FIG. 4

CARTRIDGE FOR CORRECTION MEDIA OR TACKY TAPE WITH A WRAP SPRING

BACKGROUND OF THE INVENTION

Correcting typewriters utilizing adhesive correction media have been available in significant numbers since 1973 in the commercial marketplace. The previous correction tape constituted a reel to reel arrangement where each reel, takeup and supply were separate and independent and not commonly supported.

With the increased usage of ribbons in cartridges, it has become desirable to include the correction tape in a cartridge for ease in handling and ease in installation. By including the correction tape in the cartridge, it is also considerably easier to design a ribbon and correction tape feed mechanism to accommodate the cartridge than to have to accommodate a ribbon cartridge and separate and loose correction tape spools. With the inclusion of the correction tape within a correction tape cartridge, the physical volume occupied by the completely filled takeup spool becomes a consideration and, in many cases, a limiting consideration as to the quantity of tape that may be originally placed in the cartridge and the ability to consume all of the correction tape supplied.

One complicating factor when dealing with correction tapes generally not found when dealing with such things as film ribbons and fabric ribbons is that film and fabric ribbons will slip with respect to each other in a particular convolution while the tacky surface of the correction tape does not readily slip in the same manner. This non-slip nature of the correction tape resists normal smoothing of the takeup convolutions as may be accomplished with ribbons by tension. Therefore, once the material has become adhered to the adjacent backing, it is virtually impossible to cause a slipping by means of tension only.

As a result, any wrinkle inadvertently formed will propogate throughout the remainder of the radius of the takeup spool with additional convolutions.

Tensioning devices have been disclosed in the past which engage the periphery of ribbon spools. The most pertinent example of a tensioning device engaging the periphery of a takeup spool is found in U.S. Pat. No. 4,013,160. A second version of that device is illustrated in U.S. Pat. No. 4,147,439. In both cases, the ends of the spring member which constitutes a drag force on the supply spool has a second end engaged with the periphery of the takeup spool for purposes of forming a bias force between the two spools. The patents indicate that the function and purpose is that of providing a tension to the web and that a relatively high friction surface material is attached to the arm engaged with the supply spool to that end. Also, the braking surface is formed such that if a bulge is present, the action of the bulge against the brake will cause the brake to cam out and allow passage of the bulge.

This device, although providing the desired tension, does not appear to have any beneficial effect as far as maintaining a well ordered takeup spool inasmuch as the ribbon being transmitted will slip with respect to the next convolution and, therefore, does not present the problem encountered in the takeup spool portion of the correction tape cartridge disclosed in this application.

DRAWING

FIG. 1 illustrates a printer ribbon cartridge with the takeup spool exposed and the spring in wiping relationship with the outer convolution of the takeup spool.

FIG. 2 illustrates the type of voids which will typically form without the use of some member to insure proper engagement with the periphery of the takeup spool and tape disc.

FIG. 3 illustrates a mode of operation wherein the wiper spring may contact the periphery of the takeup spool prematurely.

FIG. 4 illustrates the spring of FIG. 1 showing a relieved cross sectional portion of FIG. 4.

FIG. 5 illustrates an alternative embodiment of the relieved cross section of the spring illustrated in FIG. 4.

OBJECTS OF THE INVENTION

Figure 6:
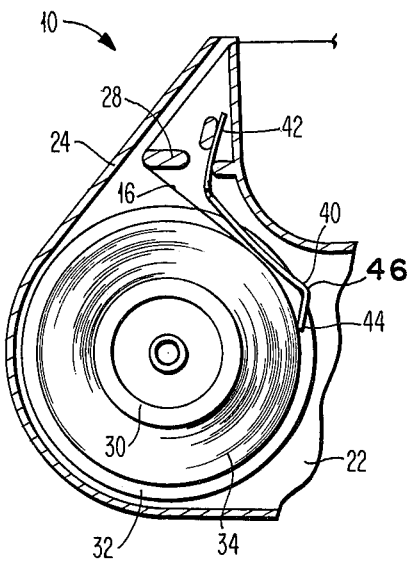
FIG. 6 illustrates the relieved cross section spring on a substantially full takeup spool.

It is an object of this invention to insure an orderly accumulation of adhesive correction tape on a takeup spool within a cartridge.

It is another object of this invention to prevent the takeup spool of an adhesive correction cartridge from having voids and wrinkles therein.

It is another object of this invention to insure a complete utility of all the materials supplied in the cartridge by preventing premature takeup spool failure.

The embodiment illustrated herein serve to overcome the shortcomings of the prior art and accomplish the objects of the invention.

SUMMARY OF THE INVENTION

As correction material and particularly lift-off tape which has an adhesive nature is spooled onto the takeup spool of the correction material cartridge, it is necessary to prevent buckles and wrinkles in the web material as wound. This is accomplished by engaging the outer cylindrical surface of the takeup tape disc with a wiper to insure that the new wrap is firmly pressed against the previous wrap. In order to insure adequate relief where the takeup spool is anticipated to become large enough to prematurely contact the main arm of the wiper, a relieved section in the spring structure will sufficiently weaken that section to concentrate the bend at that point permitting full utilization of the takeup spool diameter, in constrained space.

A better understanding of the invention may be had from the more detailed description to follow.

DETAILED DESCRIPTION OF THE DRAWING

FIG. 1 illustrates a printer or typewriter ribbon cartridge 10 having a supply spool 12 of correction tape 16 and a tensioning wire 14 engaging the back surface of tape 16. Tape 16 will exit from the chamber of cartridge 10 at exit port 18. The chamber of cartridge 10 is formed by a top wall 20, a bottom wall 22 and side walls 24. Tape 16 extends across the front portion of cartridge 10 and reenters the cartridge 10 at reentry port 26. Upon reentry, the tape 16 is passed around guide post 28 to prevent the tape 16 from wrapping too sharply along the wall 24 which partially forms reentry port 26. As correction tape 16 passes the guide post 28, it is then pulled in a straight line to a position on the tangent of the takeup spool 30 having flange 32 thereon. As the tape 16 reaches the tangent point of the circumference of the tape spool or disc 34, the tacky or sticky surface of the tape 16 will engage the previously wound convolution.

As the tape 16 comes in contact with the periphery of tape disc 34, the tape 16 may contact the disc 34 slightly prior to the tangent point between tape 16 and disc 34 and possibly form a small buckle or bubble type discontinuity in the cylindrical exterior.

When this occurs and winding continues, the buckles and bubbles will propogate throughout the disc 34 and will show up as bulges 36 as illustrated in FIG. 2. This condition will continue and will consume substantial extra space on the takeup spool 30 until the periphery of the tape disc 34 becomes as large or larger than the flange 32 on takeup spool 30. At this point, the cartridge 10 is no longer useable and any remaining tape 16 contained on the supply spool 12 is wasted. Referring back to FIG. 1, a technique for preventing the buckle and bubble types of problem in accumulating the tape 16 onto the disc 34 is spring member 40. Spring member 40 can also be viewed in FIG. 4. Spring member 40 is comprised of a main beam portion, a grounding segment 42 and a wiping portion 44. The wiping portion 44 and spring member 40 are joined at a bend 46 which allows the orientation of wiping portion 44 at an angle with respect to both the surface of disc 34 and spring member 40. The wiping action of the edge of wiping portion 44 relatively firmly places the adhesive surface of tape 16 into engagement with the outer wrap of disc 34 and it is believed that it effectively squeeges the buckle until such time as the lightly adhesive engagement of tape 16 and the disc 34 upstream from the wiping portion 44 breaks away due to tension, thus insuring the prevention of the buckle or bubble such as is seen at 36 in FIG. 2. The wiping edge of wiping portion 44 insures a smooth engagement of tape 16 with disc 34. A further improvement is shown in FIG. 1 and FIG. 4 with a second embodiment in FIG. 5. Spring member 40 may have a relieved portion 50 intermediate a pair of notches 52 or 54. Notches 52 take the shape of semi-circular portions being removed from spring member 40 between the main portion of the spring member 40 and the grounding segment 42. FIG. 5 illustrates the use of triangular punched notches 54 to accomplish the same relieving of the relieved portion 50.

Cartridge 10 in FIG. 3 is illustrated as it has approached and arrived at completion of usage. The capacity of the cartridge 10 may be increased to accommodate additional tape 16 by implementing one of the embodiments illustrated in FIG. 4 or 5. FIG. 3 illustrates an embodiment wherein the quantity of tape 16 does not exceed the flex capability of spring member 40. The engagement of tape 16 with the outer convolutions of disc 34 at a point other than the point of engagement between wiping portion 44 and disc 34 may potentially permit surface irregularities to form.

This arrangement shown in FIG. 3 is fully satisfactory where the ultimate diameter of the takeup disc 34 will be less than that which will cause engagement between disc 34 and spring member 40. The increase in the capacity of spool 30 so that the disc diameter may approach the maximum diameter of flange 32 may be accomplished by relieving the cross section of beam spring member 40 such as illustrated in FIGS. 4 and 5. The relief by the use of notches 52, 54 or any other conventional technique for reducing the cross sectional area of beam spring member 40 will accomplish the desired result. By reducing the cross sectional area and thus the ability of that section of spring member 40 to withstand the stresses of flexure under an incresing diameter of the disc 34, the radius of bend of spring member 40 at that point will be substantially reduced with respect to the radius of bend in the main beam portion 40. With the concentration of the flexure at the relieved portion 50, the main beam portion 40 is permitted to maintain a larger radius or a flatter configuration, thus insuring that the wiping portion 44 will engage the periphery of tape disc 34 in the desired manner to an increased diameter of disc 34.

Other examples of reducing the relieved portion 50 of the spring member 40 would include rectangular notching and a coining operation whereby the coining dye will deform the spring member 40 to make relieved portion 50 thinner.

Bend 46 is of a sufficient angle as to cause wiping portion 44 to engage the disc 34 in a wiping action at all orientations.

Figure 7:
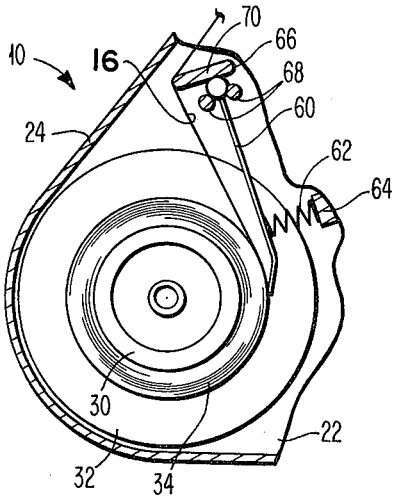
FIG. 7 illustrates an alternate spring biasing approach.

Referring to FIG. 7, a rigid wiper member 60 or a spring 60 of less flexibility than those of FIGS. 1–6 is illustrated. The bias is provided by compression spring 62 against stop 64. Spring 60 is formed with a retaining bulge 66 on the end which pivots between posts 68 and abutment 70 which also serves as a ribbon guide.

We claim:

1. A typewriter cartridge for containing a tacky adhesive web comprising:

a top, bottom and side walls forming a chamber, a supply means, a takeup spool, said takeup spool supported for rotation within said cartridge, said side walls forming entrance and exit apertures, a web extending from said supply means to said takeup spool and through said exit and entrance apertures to form an exposed portion of said web exterior to said cartridge, said web having at least one tacky adhesive surface, said takeup spool having thereon accumulated convolutions of said web that has been used, including a last convolution, and beam spring means supported by said cartridge and having a terminal edge, said terminal edge positioned in squeegeeing relation to said convolutions for forcing said web against said accumulated convolutions of said web on said takeup spool, said terminal edge positioned to be the only portion of said beam spring means engaging said web, to remove buckles in said web and said last convolution, said beam spring means formed with a portion of said beam spring means having one end, comprising said terminal edge, bent at an angle to said beam spring means, said beam spring means having a localized reduced cross section comprising the remainder of a cross section of said beam spring means with notches formed in the edges thereof, and support means for supporting said beam spring means and wherein said reduced cross section is proximate said support means of said cartridge, whereby the bending stress exerted on said beam spring means by said convolutions of said web are concentrated at said reduced cross section and thereby permitting a larger radius in the remaining portion of said beam spring means to insure engagement of said terminal edge with said web in a squeegeeing relation.

2. The cartridge of claim 1 wherein said notches are semi-circular in shape.

3. The cartridge of claim 1 wherein said notches are triangular in shape.

* * * * *